US006463703B1

(12) United States Patent
Mattis

(10) Patent No.: US 6,463,703 B1
(45) Date of Patent: Oct. 15, 2002

(54) BURIAL MONUMENT WITH MEMORABILIA STORAGE DEVICE

(76) Inventor: Martin P. Mattis, PMB #201, 90 Alexandria Pike, Ste. 19, Ft. Thomas, KY (US) 41075

( * ) Notice: Subject to any disclaimer, the term of this patent is extended or adjusted under 35 U.S.C. 154(b) by 0 days.

(21) Appl. No.: 09/430,779

(22) Filed: Oct. 30, 1999

(51) Int. Cl.[7] ..... E01F 9/011
(52) U.S. Cl. ..... 52/103
(58) Field of Search ..... 47/41.1, 41.14; 52/103; 40/124.5

(56) References Cited

U.S. PATENT DOCUMENTS 291,106 A * 1/1884 Strong
669,412 A * 3/1901 Harriman
682,950 A * 9/1901 McNeal
754,269 A * 3/1904 Witt et al.
4,227,325 A 10/1980 Whitford
4,324,026 A 4/1982 Craft
5,553,426 A 9/1996 Ostergard
5,729,921 A 3/1998 Rojas
5,732,515 A 3/1998 Rodrigues et al.
6,088,955 A * 7/2000 Nelson, Jr. et al.

* cited by examiner

*Primary Examiner*—Milton Nelson, Jr.
(74) *Attorney, Agent, or Firm*—R. Christian Macke

(57) ABSTRACT

A burial monument having a memorabilia storage compartment incorporated therein. A monument is solid construction has a cylindrical boring removed to provide a compartment within the solid monument. The compartment is closed to form an airtight and watertight chamber by providing a cap with a gasket affixed thereto. The cap engages a threaded inner ring or is hinge mounted to the monument in alternative embodiments. A method for modifying burial monuments to provide a memorabilia storage compartment is also disclosed.

8 Claims, 3 Drawing Sheets

BURIAL MONUMENT WITH MEMORABILIA STORAGE DEVICE

FIELD OF THE INVENTION

A memorabilia storage device incorporated in a burial monument and a method for modifying an existing monument to provide such a device is disclosed herein.

BACKGROUND OF THE INVENTION

The desire to keep sentimental items close to the burial site of a person is well known, and a number of devices have been provided in the prior art for storing memorabilia in or near a tomb or grave site. The provision for memorabilia storage near a tomb or grave site is meaningful, because it gives many people peace of mind prior to death by knowing that they will still be in close proximity to objects that have sentimental value. Providing a memorabilia storage compartment that is accessible to visitors of a grave site is also important because it provides the visitors a sense of staying in touch with the decedent by changing or adding memorabilia stored therein. In this way, survivors can share major events with the deceased by placing pictures and other memorabilia in the storage compartment.

A number of prior art devices provide a memorabilia storage compartment as part of a casket in which the deceased will be buried or, in the case of a cremation, as part of the urn or urn storage device in which the ashes are stored. U.S. Pat. Nos. 5,727,291; 5,678,289; and 5,675,876 all provide caskets having compartments therein for storage of memorabilia and artifacts that have sentimental meaning to the deceased. It is a significant disadvantage of the casket incorporated memorabilia storage compartments, though, that they are not accessible after the casket is buried. Thus, they afford no opportunity to the family and friends of the deceased to "stay in touch" with the deceased through additions or changes to the memorabilia stored in the compartment.

A number of other devices in the prior art disclose memorabilia storage compartments that can be viewed by visitors to the grave site. U.S. Pat. Nos. 4,227,325 discloses a grave marker including a cylindrical chamber that rests on top of the marker in which memorabilia is stored and displayed to those who visit the grave site through a small opening in the cylinder. The storage cylinder is not incorporated into the grave marker, but rather is supported thereon by dual supports.

U.S. Pat. No. 5,553,426 discloses a gasketed lock-box for storage of memorabilia that is anchored into the ground near the burial site. The '426 patent comprises a hollow box and is not incorporated with or into a traditional stone, granite or marble monument. A significant disadvantage of the '426 patent is that it would be subject to collapse under heavy weight, such as a lawnmower and would be subjected to expansion and contraction with temperature changes, disadvantageous compared to a stone, granite or marble monument of solid construction.

U.S. Pat. No. 5,729,921 discloses a burial marker having an air and water tight container therein that is accessible to visitors of the grave site. It also includes a cylindrical container in which memorabilia is retained. The marker 12 of the '921 patent is a box that is interred in the ground, like a headstone, but the box 112 is not a traditional headstone comprising stone, granite, marble or any other rigid material. Rather, the box 12 is constructed from material such as plastic that is very light and easy to mold. It is a significant disadvantage of the '921 marker that it is so constructed because such an embodiment lacks the strength and rigidity to withstand the shifts and temperature changes in the surrounding ground or heavy weight placed upon it, such as a lawnmower.

None of the prior art devices disclose a memorabilia storage device or compartment that is formed as part of a heavy, rigid monument with closure means affixed to the monument. While it is well known that burial monuments may be raised out of the ground or buried to be flush with the ground, there is no device or method in the prior art whereby a memorabilia storage compartment can be formed in the monument itself and accessed either through the top of the marker, for those monuments that are flush with the ground, or the front, back or side of the marker for those that are raised above the ground. In addition, none of the prior art devices disclose a memorabilia storage compartment that solely comprises materials such as brass, porcelain, marble and granite that are generally accepted in cemeteries because of their resistance to weather. Many cemeteries have restrictions as to what materials may be included in burial monuments, and specifically preclude plastics and similar materials that are prone to weathering and breakage.

OBJECTION OF THE INVENTION

It is an object of the present invention to provide a burial monument having a compartment accessible to visitors to a grave site wherein memorabilia can be stored.

It is another object of the present invention to provide a burial monument having a memorabilia storage compartment incorporated into the monument itself.

It is yet another object of the present invention to provide a method for modifying an existing burial monument to provide a memorabilia storage compartment therein.

It is a further object of the present invention to provide a memorabilia storage device as part of a burial monument utilizing only brass, porcelain, marble and other weather resistant materials.

It is a further object of the present invention to provide a burial monument having a waterproof and weatherproof memorabilia storage compartment.

It is yet another object of the present invention to provide a flush mounted burial marker having a memorabilia storage compartment formed therein that is accessible to visitors to the grave site through the top face.

It is another object of the present invention to provide a raised monument or bench monument having a memorabilia storage compartment formed therein that is accessible to visitors to the grave site through a front, side or rear face.

It is a further object of the present invention to provide a burial marker having a generally rectangular memorabilia storage compartment formed therein.

These and other objects and advantages of the present invention will be apparent from a review of the following specification and accompanying drawings.

SUMMARY OF THE INVENTION

The burial marker of the present invention comprises a weather resistant monument of solid construction wherein a memorabilia storage compartment is formed. A means for closing the memorabilia storage compartment is also provided which protects the interior of the compartment and memorabilia stored therein from water and weather. In the most preferred embodiment of the present invention, the memorabilia storage compartment comprises a cylindrical boring in the weather resistant monument and the closing means comprises a removable cap providing access to the storage compartment. A recessed ring is received within an annular cut out of larger diameter than the cylindrical boring comprising the storage compartment, the ring being affixed to the monument through the use of adhesive. The recessed ring has an interior thread which corresponds to an external thread of a downwardly depending shaft of a removable cap. A gasket surrounds the downwardly depending shaft and is affixed to the cap such that, when the cap is positioned so that the exterior thread engages the interior thread of the recessed ring, rotating of the cap tightens down the cap onto the monument until the gasket is compressed to form a seal between the cap and monument. This preferred embodiment of the present invention is particularly advantageous because the memorabilia storage compartment may be formed in the top, front, or back of a monument, and so is adaptable for upright, slant, bevel, flush, bench or mausoleum monuments. The removable cap is the only element of the memorabilia storage device that is exposed so that memorabilia stored therein is not subjected to rain or weather, but rather is protected from the elements.

In another preferred embodiment of the present invention, the closing means related to the memorabilia storage compartment is provided by a cover that is permanently affixed to the monument by a hinge. The cover is positioned on the monument such that it completely covers the memorabilia storage compartment when closed. The hinge is spring loaded to bias the cover against a flat surface of the monument. A gasket affixed to the underside of the hinged cover provides a seal between the cover and the monument.

In another embodiment of the present invention, the memorabilia storage compartment formed in a burial monument is generally rectangularly shaped and the hinged cover is correspondingly generally rectangularly shaped. The gasket affixed to the hinged cover is also generally rectangularly shaped and engages a face of the monument at a flat surface. The flat surface is advantageous in that the seal formed by the gasket is improved for a machined flat surface.

A method for storing memorabilia in close proximity to a burial site incorporating the principles of the present invention is also provided. Memorabilia is stored by first providing a weather resistant monument of solid construction. This method can be applied for new or existing monuments. A cylindrical cavity is bored into the weather resistant monument, followed by a boring of the monument on the same center as the cylindrical cavity to provide a larger diameter annular cut out. A ring having an interior thread is then positioned and affixed to a shelf formed by the larger diameter annular cut out. A cap is then provided which has a downwardly depending shaft with an exterior thread thereon that corresponds to the interior thread of the recessed ring.

DETAILED DESCRIPTION OF THE INVENTION

The present invention comprises a burial marker 10 comprising a monument 11 of solid construction positioned near a grave site, the monument 11 having therein a memorabilia storage compartment 18. The burial marker 10 of the present invention embodying the principles of the present invention may be an upright, slant, bevel, flush bench or mausoleum marker. The memorabilia storage compartment 18 may be formed in a front, side or back face of the monument 11 to provide maximum accessibility to visitors to the burial site. The principles of the present invention are particularly well suited to provide memorabilia storage compartments in new burial markers or in existing burial markers through a modification embodied by the method of the present invention.

Figure 1:
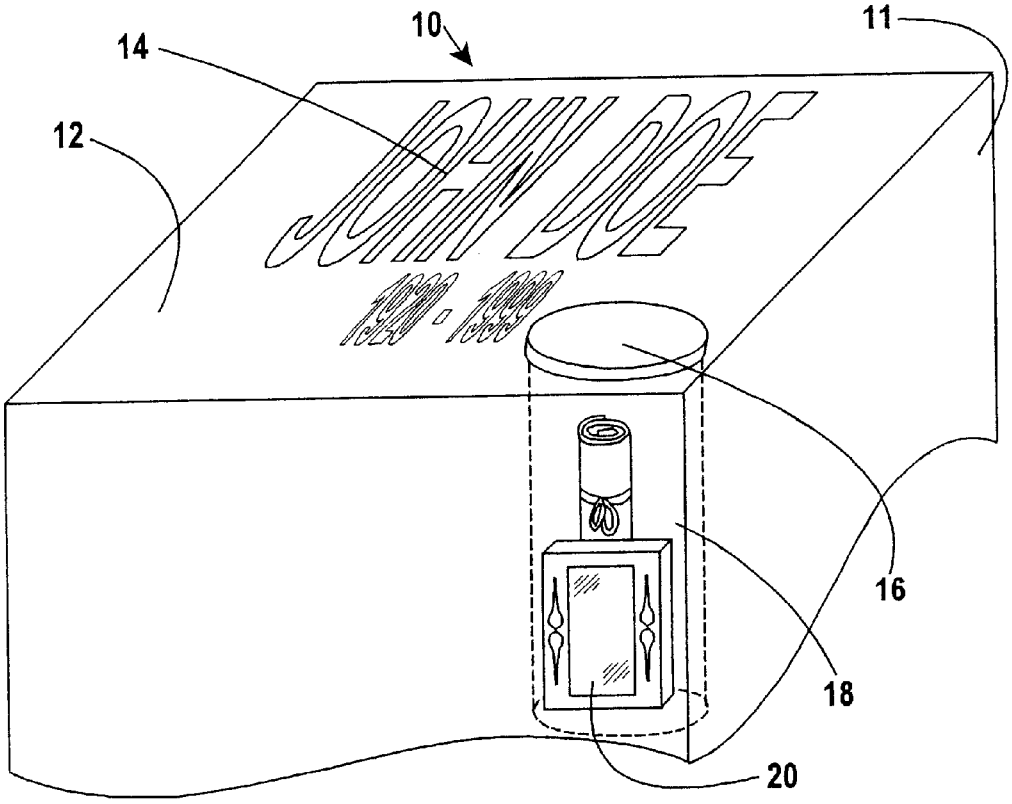
FIG. 1 is a perspective view of a flush mount burial monument with a memorabilia storage compartment accessible on the top.
Figure 6:
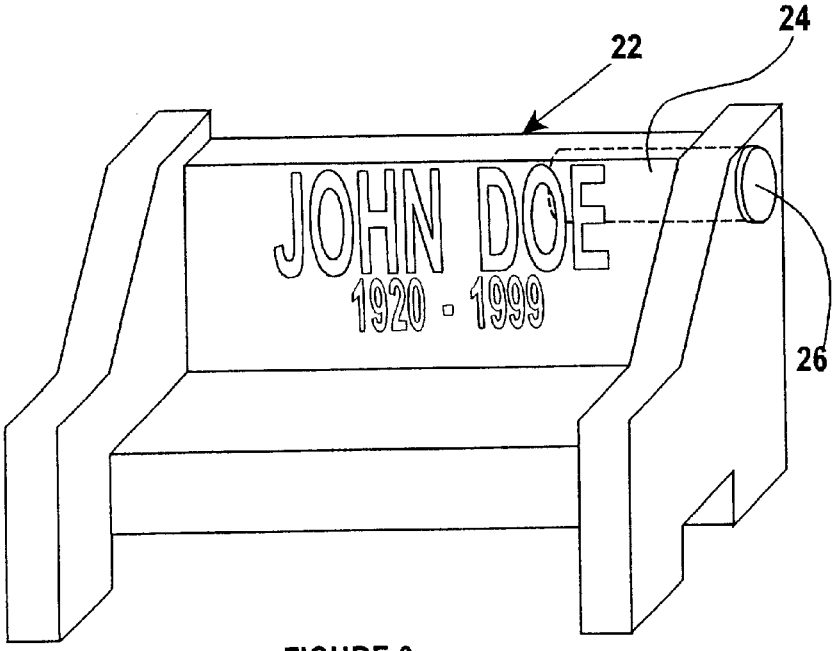
FIG. 6 is a perspective view of a bench monument having a memorabilia storage compartment formed therein.

In the most preferred embodiment of the present invention, the memorabilia storage compartment 18 is formed in the flush mount monument 11 so as to be accessible at the upper surface 12 of monument 11. As shown in FIG. 1, the cap 16 over the memorabilia storage compartment 18 is provided on the upper surface 12 alongside, and may be incorporated with, the monument inscription 14. As shown in FIG. 1, the memorabilia storage compartment of the present invention comprises a cylindrical boring 18 into the monument 11 which, because of the rigidity and stability of the monument 11, constructed from granite, stone or marble, comprises a sturdy protective cavity for the enclosure of memorabilia 20 provided by the deceased or visitors to the grave site.

Figure 2:
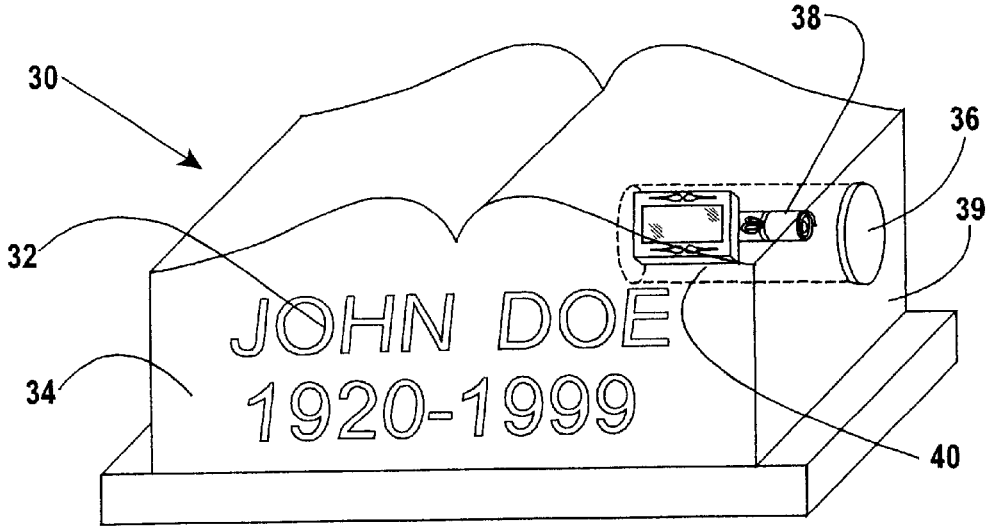
FIG. 2 is a perspective view of a raised burial monument having a memorabilia storage compartment accessible on the side of the monument.

In another embodiment of the present invention, a raised monument 30 is depicted in FIG. 2 as having an inscription 32 on its front face 34. To enhance the aesthetic qualities of the monument 30 and to avoid interference between the memorabilia storage compartment cap 36 and the inscription 32, the cylindrical boring 38 providing the memorabilia storage compartment 38 is made accessible at a side face 39 of the monument 30. By providing the cap 36 to seal the memorabilia storage compartment 38, the memorabilia 40 stored therein is protected from the weather in a stable and sturdy compartment 38 formed within the monument 30 itself.

In another embodiment, a memorabilia storage compartment 24 is formed in an upright portion of a memorial bench 22. A cap 26 allows the memorabilia storage compartment 24 to be maintained airtight and watertight to protect memorabilia stored therein.

Figure 3:
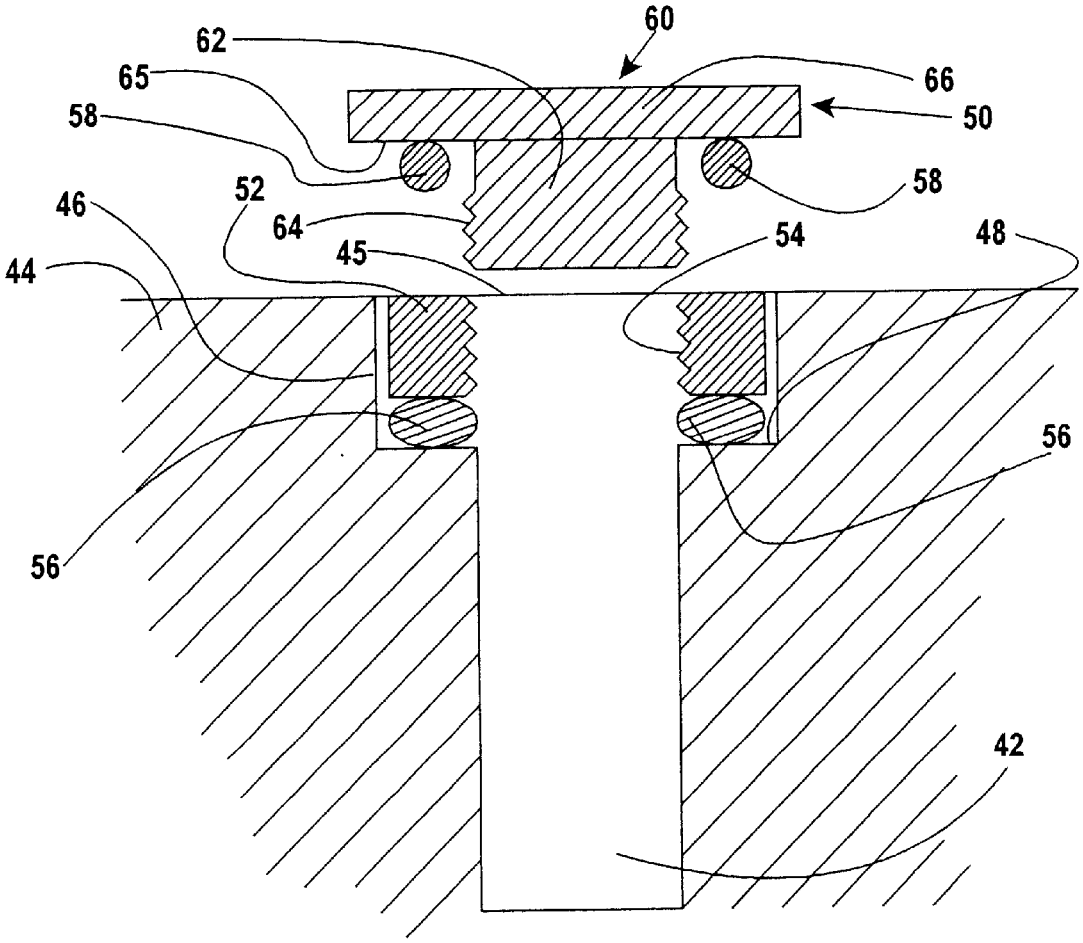
FIG. 3 is the detailed section view of the memorabilia storage compartment.

A more detailed view of a memorabilia storage compartment 42 embodying the principles of the present invention is provided at the sectional view of FIG. 3. A cylindrical boring 42 in which memorabilia may be stored is shown, the boring 42 having been removed from a monument 44 of solid construction. To accommodate the inclusion of a means for closing and sealing the storage compartment 42 , a larger diameter annular cutout 46 is also made in the monument 44 near the upper face 45 of the monument 44 to provide an upper shelf 48. The closing means 50 comprises a recessed ring 52 having an interior thread 54. The recessed ring 52 is positioned on the upper shelf 48 and permanently affixed to the monument 44 through the use of a bonding agent, such as adhesive 56.

To make the storage compartment 42 of the preferred embodiment of the invention watertight and airtight, a gasket ring 58 is provided which is positioned between the recessed ring 52 and the cap 60. The cap 60 has a downwardly extending shaft 62 having an exterior thread 64 and a larger diameter head 66.

Closure and sealing of the storage compartment 42 is effected when the cap 60 is positioned near the monument 44 so that the interior thread 54 of the recessed ring 52 is engaged by the exterior thread 64 of the downwardly extending shaft 62 affixed to the cap 60. Rotation of the cap 60 results in a screwing down of the cap 60 toward the face 45 of the monument 44. The cap 60 is screwed down sufficiently that the gasket 58 is compressed between the face 45 and the underside 65 of the cap 60. When sufficiently compressed, the gasket 58 forms an airtight and watertight seal to prevent any contaminants from invading the storage compartment 42, thereby protecting the memorabilia stored therein.

Figure 4:
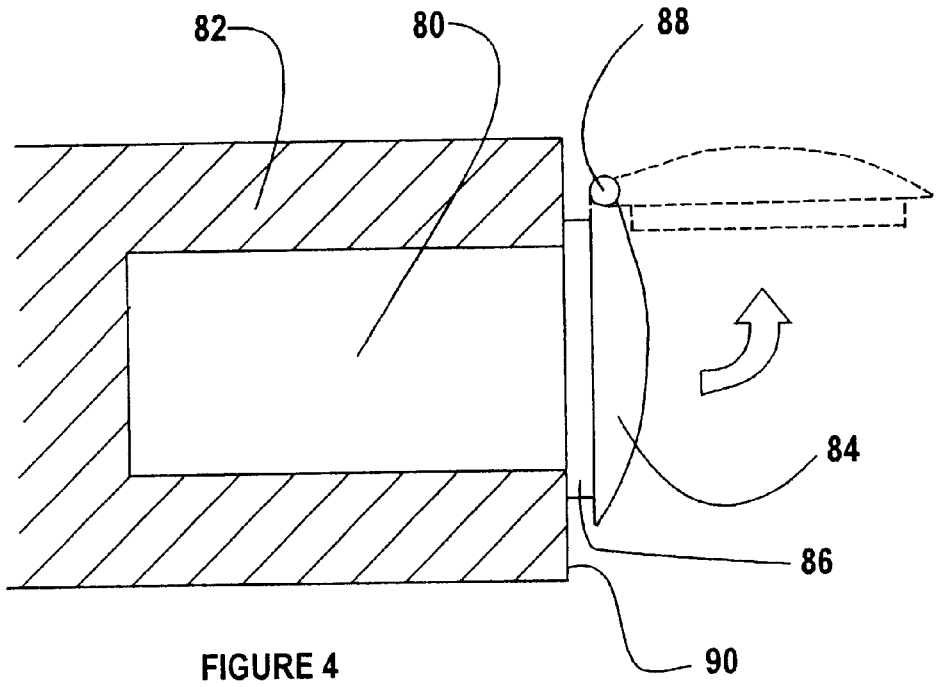
FIG. 4 is the detailed section view of the memorabilia storage compartment with a hinged and gasketed cover.

In another preferred embodiment of the present invention, a memorabilia storage compartment 80 is provided comprising a cylindrical cutout 80 formed in a monument 82 of solid construction. A closing means for the compartment 80 is provided comprising a cap 84 that is permanently affixed to the monument 82 at a hinge 88. Attached to the underside of the cap 84 is a gasket 86 which, when the cap is rotated into engagement with the face 90 of the monument 82, forms an airtight and watertight seal preventing contamination of the storage compartment 80 or memorabilia stored therein. The hinge 88 is spring loaded to maintain the cap 84 in a closed position so that accessing the memorabilia storage compartment 80 requires rotation of the cap 84 about the hinge 88 as shown in FIG. 4.

Figure 5:
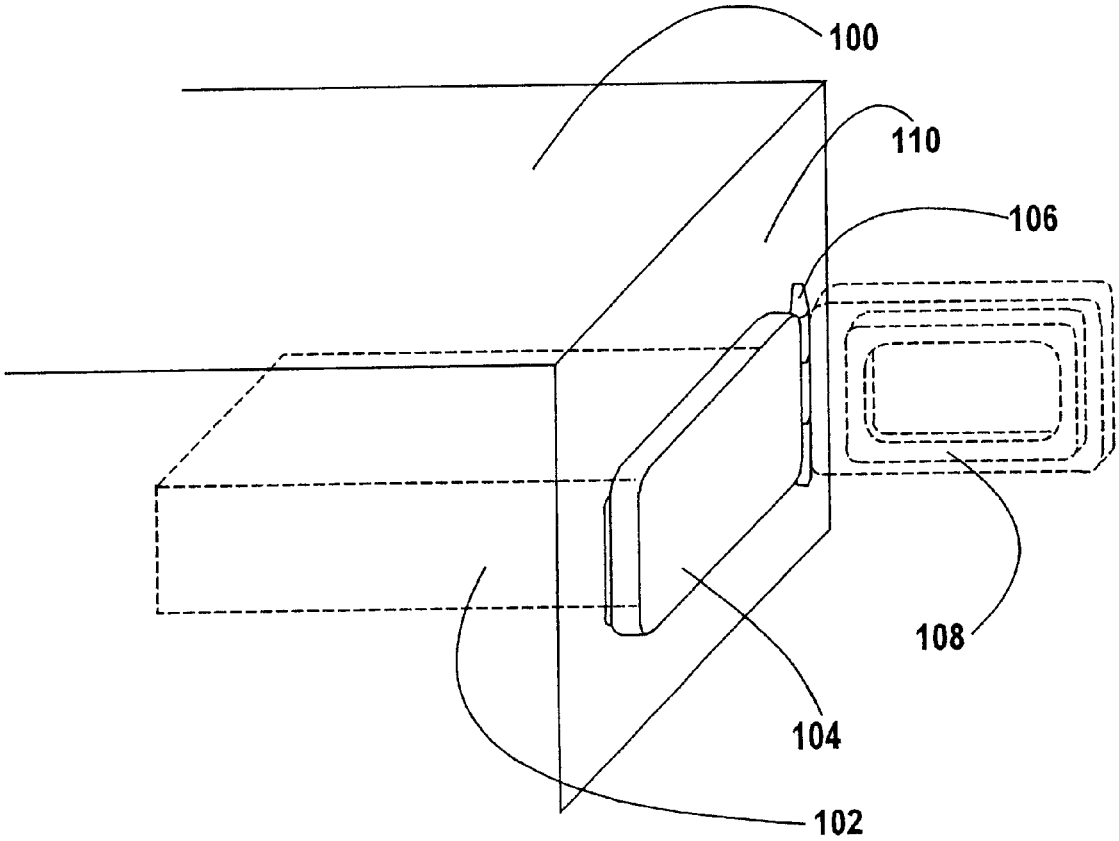
FIG. 5 is a partial perspective view of a burial marker having a generally rectangularly shaped memorabilia storage compartment therein.

Another embodiment of the present invention, shown in FIG. 5, is a burial monument 100 having a generally rectangularly shaped memorabilia storage compartment 102 formed therein. A generally rectangularly shaped cover 104 is provided, permanently affixed to the monument 100 at hinge 106. The hinge 106 is spring biased to maintain the cover 104 in a closed position against the monument 100 so that the gasket 108, affixed to the cover 104, forms an airtight and watertight seal. To further enhance the seal formed by the gasket 108, that portion of the side face 110 engaged by the gasket 108 is machined flat.

It is contemplated by the principles of the present invention that any of the memorabilia storage compartments disclosed herein may be provided with locking mechanisms without disclosing from the principles of the present invention. Specifically, a key/latch locking mechanism may be incorporated in any of the caps 16, 26,36, 60, 84, 104 to provide a secure memorabilia storage compartment.

A method for storing memorabilia in close proximity to a burial site is also embodied by the principles of the present invention which provides for storage of memorabilia not only with new monuments, but also with existing monuments through steps of modification. The first step in providing for memorabilia storage in close proximity to a burial site is to provide a weather resistant monument 11 of solid construction. Next, a cylindrical cavity 18 is formed in the monument 11 of sufficient diameter to hold memorabilia such as cards and letters that have sentimental value to the deceased or visitors to the grave site. Next, a larger diameter annular cut out is formed in the monument 11 on the same center as the cylindrical cavity 18, an interior shelf 48 being formed near the face 45 of the monument 44 (FIG. 3). A ring 52 having an interior thread 54 is then affixed to the shelf 48 and a cap 60 having a downwardly extending shaft 62 with an exterior thread 64 is provided. The interior thread 54 is then engaged by the exterior thread 64 and the cap 60 is rotated to effect closure of the memorabilia storage compartment 42.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A burial marker comprising:

a weather resistant monument of solid construction;

a memorabilia storage compartment formed in said weather resistant monument; and means for closing said memorabilia storage compartment, said closing means further comprising a removable cap and a compressible sealing gasket forming an airtight and watertight seal between said removable cap and said weather resistant monument.

2. The burial marker of claim 1 wherein said memorabilia storage compartment comprises a sturdy protective cavity formed as a cylindrical boring in said weather resistant monument of solid construction.

3. The burial marker of claim 2 wherein said closing means further comprises a hinged cover permanently affixed to said weather resistant monument, said hinged cover having a sealing gasket affixed thereto.

4. The burial marker of claim 2 wherein said closing means further comprises a recessed ring receiving a downwardly extending shaft from said removable cap, said recessed ring being positioned on an upper shelf comprising an annular cutout in said weather resistant monument.

5. The burial marker of claim 4 wherein said closing means further comprises an internal thread on said recessed ring and an external thread on said downwardly extending shaft.

6. The burial marker of claim 5 wherein said recessed ring is permanently affixed to said weather resistant monument.

7. The burial marker of claim 6 wherein said compressible sealing gasket further comprises a gasket ring compressed between a face of said weather resistant monument and an underside of said removable cap to form an airtight and watertight seal.

8. A method for storing memorabilia in close proximity to a burial site comprising the steps of:

providing a weather resistant monument of solid construction;

boring a cylindrical cavity into said weather resistant monument;

boring a larger diameter annular cutout in said weather resistant monument to provide an interior shelf;

a affixing a ring to said shelf, said ring having an internal thread;

providing a cap having a downwardly extending shaft, said shaft having an external thread corresponding to said internal thread of said ring.

* * * * *